US005709070A

United States Patent [19]

Peters

[11] Patent Number: 5,709,070

[45] Date of Patent: Jan. 20, 1998

[54] COMPOSITE STIRRUP

[76] Inventor: Martin W. Peters, HCR1 Box 25C, Barksdale, Tex. 78828

[21] Appl. No.: 451,903

[22] Filed: May 26, 1995

[51] Int. Cl.[6] ..... B68C 3/00

[52] U.S. Cl. ..... 54/47

[58] Field of Search ..... 54/47, 48, 49, 54/49.5

[56] References Cited

U.S. PATENT DOCUMENTS

| | | | |
|---|---|---|---|
| 267,961 | 11/1882 | Woolworth et al. | 54/47 |
| 283,310 | 8/1883 | Williamson | 54/47 |
| 444,298 | 1/1891 | Kerns | 54/47 |
| 808,333 | 12/1905 | Audley | 54/47 |
| 1,005,502 | 10/1911 | Bernstein | 54/47 X |
| 1,020,752 | 3/1912 | Flora | 54/47 |
| 1,384,627 | 7/1921 | Olmstead | 54/47 |
| 2,975,858 | 3/1961 | Billingsley | 54/47 X |
| 3,905,179 | 9/1975 | Bischeltsrieder | 54/47 |

FOREIGN PATENT DOCUMENTS

| | | | |
|---|---|---|---|
| 105949 | 1/1899 | Germany | 54/47 |

*Primary Examiner*—Robert P. Swiatek
*Attorney, Agent, or Firm*—Stephen R. Greiner

[57] ABSTRACT

A composite stirrup for supporting the foot of a rider in mounting and riding. The stirrup includes a U-shaped body formed from a plurality of veneers glued together in a mold of suitable shape. For increased strength and durability, a metallic strap is positioned between one pair of adjacent veneers. The metallic strap is provided with a plurality of extrusions which extend outwardly therefrom into the adjacent veneers.

7 Claims, 1 Drawing Sheet

COMPOSITE STIRRUP

FIELD OF THE INVENTION

The present invention relates generally to apparatus for harnessing an animal and, more particularly, to a stirrup of improved construction for use in mounting and riding a horse.

BACKGROUND OF THE INVENTION

Wood has long been used to fabricate stirrups of great versatility, strength and beauty. Nevertheless, stirrups made of wood have not been altogether satisfactory because they tend to develop cracks when exposed to moisture and temperature fluctuations during use. These cracks, if undetected or left unrepaired, can weaken the stirrup to the point where failure thereof is a near certainty. The safety of a user may, thus, be compromised.

Reinforced wooden stirrups have been proposed. In one such proposal, a sheet metal binding is applied to the exterior of a wooden core to prevent checking and splintering of the core material. As is well known, water or dampness will oxidize the metal in the binding, weakening it over time. Of course, the beauty of the wood is also obscured. A need, therefore, exists for a stirrup having an attractive wooden exterior whose reinforcing structure is hidden from view and isolated from the environment so as to avoid degradation from exposure thereto.

SUMMARY OF THE INVENTION

In light of the foregoing need, it is a principal object of the invention to provide a composite stirrup including a U-shaped body formed from a plurality of wooden veneers secured side-by-side. For hidden reinforcement of the U-shaped body, a flexible, metallic strap is embedded between one pair of adjacent veneers. The metallic strap formed of thin, sheet steel is very strong, durable and able to support significant loads. To increase the strength of the bond between the metallic strap and the adjacent veneers, the metallic strap is provided with a plurality of extrusions which extend outwardly therefrom into the adjacent veneers.

It is an object of the invention to provide improved elements and arrangements thereof in a stirrup for the purposes described which is relatively inexpensive, dependable and fully effective in accomplishing its intended purposes.

These and other objects of the present invention will become readily apparent upon further review of the following specification and drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
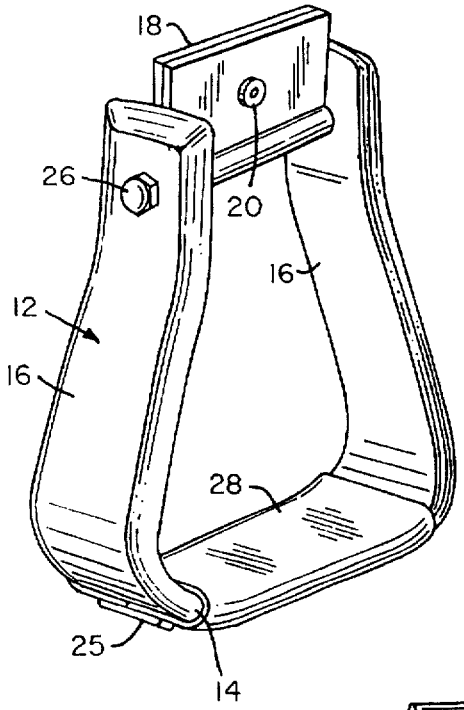
FIG. 1 is a perspective view of a composite stirrup in accordance with the present invention.
Figure 3:
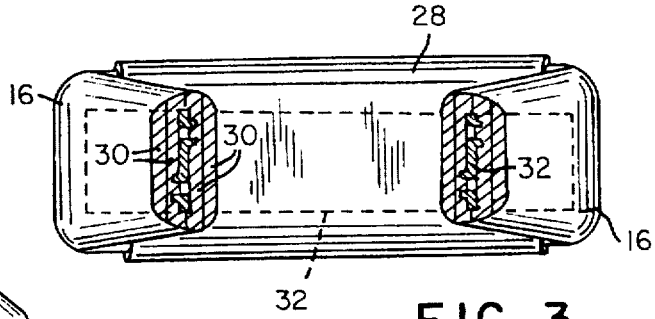
FIG. 3 is a side elevational view of the stirrup with a portion thereof having been broken away.
Figure 2:
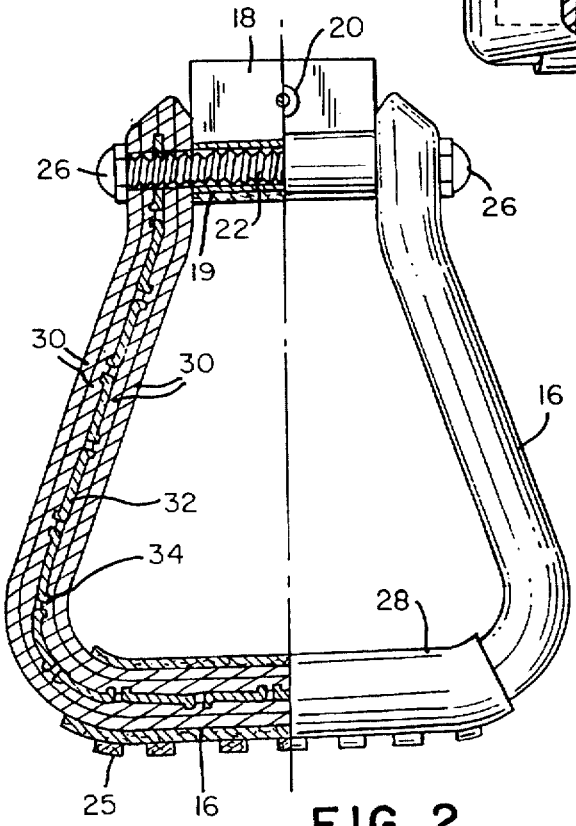
FIG. 2 is a top plan view of the stirrup of FIG. 1 having a portion broken away to reveal interior structural details thereof.
Figure 4:
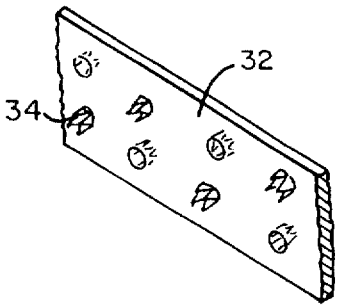
FIG. 4 is a perspective view of the metallic strap illustrating details thereof.

Referring now to the FIGS., a composite stirrup 10 in accordance with the present invention is shown. The preferred stirrup 10 includes a substantially U-shaped body 12, sized to closely receive the foot of a user, having a tread plate 14 and spaced side members 16 extending upwardly therefrom. Positioned between the free ends of side members 16 is a tubular spacer 19 carried by a threaded rod 22 fitted through holes 24 in the respective ends of side members 16. Suitable nuts 26 are threadably attached to the ends of the rod 22 and secure the rod to the U-shaped body 12. A friction-reducing sleeve 18 is secured about the spacer 19 by a rivet 20. A foot pad 28 is secured upon the tread plate 14 in the conventional manner by laces 25.

The U-shaped body 12 is manufactured substantially from a plurality of wooden veneers 30 of desired thickness. Although four veneers 30 are illustrated in the FIGS., it should be understood that this number is merely exemplary and essentially any number of veneers may be utilized in the instant invention. Thus, approximately thirty veneers 30, each having a thickness on the order of 1/28 to 1/40 of an inch, may be incorporated into a stirrup having a composite thickness of about ¾ of an inch. It is of note that a U-shaped body 12 having a composite thickness of ¾ of an inch has been found to have sufficient strength to safely support the weight of an adult.

For increased strength, between a pair of adjacent veneers 30 is positioned a flexible, metallic strap 32 preferably comprising a stainless steel alloy drawn to a thickness of approximately 1/28 of an inch. The metallic strap 32 is somewhat shorter in length than the adjacent veneers 30 and is narrower in width. As will become apparent, by dimensioning the metallic strap 32 in such a fashion, it will be fully embedded in wood in the finished stirrup 10.

To assist in bonding the metallic strap 32 to the adjacent veneers 30, such is provided with a plurality of deformed extrusions 34 at intervals about its surface. These intervals may be either fixed, so as to form a regular latticework, or entirely random in their spacing. Regardless of the relative positioning of the extrusions 34, however, each extrusion is irregular and sharp-pronged as a result from die piercing operations conducted from opposite sides of the metallic strap 32. The extrusions 34, therefore, provide the metallic strap 32 with a plurality of substantially rigid, wood-entering elements which may embed themselves into the wood grain of the pair of veneers 30 positioned adjacent to either side of the metallic strap.

To form the U-shaped body 12, the adjacent surfaces of the wooden veneers 30 and the metallic strap 32 are first coated with a slow-setting liquid adhesive and then positioned side-by-side. The resulting "sandwich" is then subjected to the usual bending operation wherein the U-shaped body 12 is given the desired stirrup shape in a mold (not shown) under pressure. Preferably, the amount of pressure applied to the U-shaped body 12 is sufficient to fully embed the metallic strap 32 and extrusions 34 within the adjacent pair of veneers 30. Pressure requirements will, of course, vary depending upon the rigidity and density of the wood chosen to form the veneers 30.

After the liquid adhesive has set, the U-shaped body 12 is removed from the mold. Upon removal, the U-shaped body 12 may be contoured as desired and provided with holes 24. Decorative inlays (not shown) may also be applied to the exterior surface of the U-shaped body for an attractive appearance. After several coats of a water-resistant finish have been applied, the stirrup is ready for use with the attachment of the spacer 19, friction-reducing sleeve 18 and foot pad 28.

While the invention has been described with a high degree of particularity, it will be appreciated by those skilled in the art that numerous modifications and substitutions may be made thereto. Therefore, it is to be understood that the present invention is not limited to the sole embodiment described above, but encompasses any and all embodiments within the scope of the following claims.

I claim:

1. A composite stirrup, comprising:

a first pair of veneers secured to one another and having a U-shape; and, a metallic strap embedded between said first pair of veneers, said metallic strap including a plurality of extrusions extending into each of said first pair of veneers.

2. The composite stirrup according to claim 1 wherein each of said first pair of veneers has a first surface positioned adjacent said metallic strap and an opposing, second surface spaced therefrom; and, said extrusions do not penetrate said second surface.

3. The composite strap according to claim 1 further comprising a rod connecting the ends of said first pair of veneers together and said ends of said first pair of veneers being located at the open side of the U-shape.

4. The composite stirrup according to claim 3 wherein said rod connects the ends of said metallic strap together.

5. The composite stirrup according to claim 1 further comprising a plurality of additional veneers secured to said first pair of veneers.

6. A composite stirrup, comprising:

U-shaped body having spaced side members and a tread plate extending transversely between said side members, said U-shaped body formed from a plurality of veneers secured together; and, a metallic strap embedded between said veneers, said metallic strap including a plurality of extrusions extending into said veneers.

7. A composite stirrup, comprising:

a U-shaped metallic strap having spaced top and bottom surfaces and a plurality of extrusions extending from said top and bottom surfaces;

a first veneer secured to said top surface of said metallic strap such that said plurality of extrusions extending from said top surface of said metallic strap extend into said first veneer; and, a second veneer secured to said bottom surface of said metallic strap such that said plurality of extrusions extending from said bottom surface of said metallic strap extend into said second veneer.

* * * * *